United States Patent [19]

Böhle et al.

[11] Patent Number: 4,762,503

[45] Date of Patent: Aug. 9, 1988

[54] MOUNTING FOR AN ELECTRICAL LIGHT BULB WITH A BAYONET LAMP BASE

[75] Inventors: Franz-Josef Böhle, Salzkotten; Hans-Peter Brockmeyer, Lippstadt; Theodor Brügger, Lippstadt; Klaus Panzer, Lippstadt, all of Fed. Rep. of Germany

[73] Assignee: Hella KG Hueck Co., Lippstadt, Fed. Rep. of Germany

[21] Appl. No.: 903,033

[22] Filed: Sep. 2, 1986

[30] Foreign Application Priority Data

Aug. 31, 1985 [DE] Fed. Rep. of Germany ..... 3531166

[51] Int. Cl.[4] ..... H01R 13/625

[52] U.S. Cl. ..... 439/336; 29/874; 439/673

[58] Field of Search ..... 339/88 R, 88 C, 176 L, 339/177 L, 181 R, 182 L, 184 L, 189 L; 439/332-337, 670-674; 29/874, 882

[56] References Cited

U.S. PATENT DOCUMENTS

| | | | |
|---|---|---|---|
| 1,229,185 | 6/1917 | Stichtenoth | 339/181 R |
| 1,935,146 | 11/1933 | Douglas | 339/181 R |
| 1,978,115 | 10/1934 | Roper | 339/181 R |
| 2,110,135 | 3/1938 | Douglas | 339/181 R |
| 2,646,477 | 7/1953 | Herterick | 339/181 R |

FOREIGN PATENT DOCUMENTS

| | | |
|---|---|---|
| 1624383 | 6/1951 | Fed. Rep. of Germany . |
| 1589224 | 8/1971 | Fed. Rep. of Germany . |
| 1815411 | 10/1973 | Fed. Rep. of Germany . |
| 2445292 | 12/1982 | Fed. Rep. of Germany . |

*Primary Examiner*—John McQuade

*Attorney, Agent, or Firm*—Horst M. Kasper

[57] ABSTRACT

Mounting for an electric light with bayonet socket. The mounting for an electric light bulb bayonet socket is stamped from a sheet metal plate or from a sheet metal band. An opening is stamped into the sheet metal plate corresponding to about the diameter of the light bulb socket in order to allow insertion of the light bulb. The guide flaps for the light bulb socket are cut from a region of the sheet metal plate which is outside of the opening for the passage of the light bulb socket. The guide flap is bend around two axes vertical to each other such that the end sections after an arcuate shaped deformation form part of a circular cylinder shaped jack.

20 Claims, 3 Drawing Sheets

MOUNTING FOR AN ELECTRICAL LIGHT BULB WITH A BAYONET LAMP BASE

BACKGROUND OF THE INVENTION

1. Field of the Invention

The invention relates to a socket for an electrical light bulb with bayonet socket, which is produced from a sheet metal plate. An opening is positioned into the sheet metal for insertion of a light bulb lamp base.

2. Brief Description of the Background of the Invention Including Prior Art

A mounting of the kind recited above, is taught for example in the German Pat. No. DE-PS2445292. According to this reference the guide flaps are cut free from the region of the sheet metal plate and are bent outwardly from an area which is otherwise stamped out as an opening for insertion of the light bulb base. The length of the guide flaps corresponds at most to about half the diameter of the opening. Such relatively short guide flaps require frequently an additional mounting body for the light bulb. This additional mounting body surrounds the light bulb base between the two guide flaps. In addition the length of the guide flaps is frequently insufficient for generating sufficiently long receiver openings for the socket pins protruding radially out of a light bulb base.

In order to achieve an effective extension of the guide flaps cut free from the region of the opening, the German petite patent DE-GM1624383 teaches to let the cut line between the two guide flaps run like a U or Z. However such shape guide flaps do not allow to insert a very long receiver openings of forming a bayonet locking.

A lamp socket for light bulbs with a bayonet lamp base is known from German Patent Laid Out No. DE-AS1815411, which is produced by rolling of a substantially rectangular plate. Two slots forming the bayonet locking are cut out of the rectangular plate and are formed further into a shell. Such a socket is associated with the disadvantage that the shell upon insertion of the light bulb can be bent apart such that the light bulb base does not receive a sufficiently good seating. Such expanding of the shell occurs in particular when a force directed radially acts at an upper edge. This occurs in such situations where the light bulb is inserted at a canted angle.

The light bulb mounting taught in German Patent laid out No. DE-AS1589224 is associated with the same disadvantages. This lamp mounting is formed as a shell with a bottom, where the cylindrical wall is formed by two regions standing out of the plate and forming wings. The two wings are rolled in each case to a ring and are completed by rectangular bending toward the shell wall. The bottom of the shell thereby serves as a receiver part for the center contact of the light bulb.

SUMMARY OF THE INVENTION

1. Purposes of the Invention

It is an object of the present invention to provide a mounting for a light bulb, where neither the length of the guide flaps nor the arcuate circle on which the guide flaps surround the light bulb socket is limited by the size of the opening for the passage of the light bulb base.

It is a further object of the present invention to provide a light bulb socket mounting, where the edge region of the opening receiving the light bulb socket is angular and closed in itself.

It is yet another object of the present invention to provide for construction of a light bulb socket, where cylindrical jacks engage bayonet pins, which cylindrical jacks are made from a single sheet metal piece together with an insertion opening, but where two bands are provided between the opening of the sheet metal bayonet area and the locking area of the sheet metal plate for proper positioning.

These and other objects and advantages of the present invention will become evident from the description which follows.

2. Brief Description of the Invention

The present invention provides a mounting for an electric light bulb with a bayonet lamp base which mounting is formed of a sheet metal plate. An opening in the sheet metal plate provides a passage for the base of a light bulb. Two guide flap pieces are provided, where one guide flap piece is cut an area of the sheet metal disposed outside of the opening in the sheet metal plate for the passage of the light bulb. A first region of the flap adjoining a region of the opening is bent in a direction about parallel to a direction of insertion of a light bulb in said opening about a line running in parallel to the plane of the opening. A second region of the flap adjoining the first region of the flap is bent in a direction toward a cylinder defined by a perpendicular projection of said opening about an axis running about perpendicular to a plane of the opening. A third region of said flap adjoining the second region is formed as part of a cylinder jacket about concentric to the cylinder defined by a perpendicular projection of said opening such that the axis of the cylinder jackets is about parallel to the axis running about perpendicular to the opening. Each third region includes a receiver opening for a socket pin radially projecting out of the light bulb socket.

A bending angle of about 90 degrees can be formed around the first bending line and a bending angle of about 90 degrees can be formed around the second bending line with a radius of curvature directed toward said cylinder. A curved region joining the second and the third region of the flap forms part of a cylinder where the radius of curvature is directed away from the axis of the cylinder jackets. An extension of the first region of the flap can be provided forming a contact tongue for electrically connecting the formed sheet metal plate to a pole of an electrical power source. A locking element can be disposed at the guide flaps for the light bulb base in the first region between the first bending line and the second bending line, where the locking element locks the formed sheet metal piece to a support mount. The locking element is preferably an opening for engaging a nose of a support mount for the formed sheet metal plate. The support mount can include a springing arm placed between a second region of one flap and a third region of a second flap formed of the same sheet metal plate.

The first region of the flap between the first bending line and the second bending line is preferably formed as a protruding edge for locking the lamp base in a plastic support mount, where the protruding edge is gripped by a head of a spring-elastic arm of the plastic support mount. Arms can be cut and bent out of an area of the sheet metal plate surrounding the opening for receiving a light bulb, which arms rest when mounted to a support mount at a receiver part of the support mount. The bayonet slot cut into the third region of the flap for receiving the socket pins of the light bulb is closed in a direction parallel to an insertion direction of a light bulb. The bayonet slots are preferably open on the side of the edge of the guide flaps directed toward the opening for the light bulb. A release recess of the opening for the light bulb can be disposed opposite to the slot opening. The release recess can extend over a large arc of a circumference of the opening such that the opening of the slots allows a range of positions of a bayonet pin during insertion of a light bulb.

The open diameter between the cylindrical jacket regions of two flaps is slightly less than the nominal diameter of a light bulb base. An edge of the guide flap neighboring the opening for insertion of a light bulb is preferably positioned outwardly as a guide bevel. A tongue is formed at an edge of the guide flap neighboring the opening, where the tongue is fixedly engaged with an edge of the opening. The edge of the opening is preferably bent in the direction of insertion of a light bulb. Centering bores can be positioned in a planar edge of the opening of the sheet metal plate. A line joining oppositely disposed socket pins of a light bulb preferably forms an angle of more than about 80 degrees with a plane disposed vertical to the first bending line, where the socket pins are in the locked rest position in the socket.

There is also provided a method for producing a mounting for an electric light bulb with a bayonet lamp base which mounting is formed of a sheet metal plate. A sheet metal plate is cut to have an opening providing a passage for the lamp base of the light bulb. The mounting can have two guide flap pieces. One guide flap piece is cut from an area of the sheet metal disposed outside of the opening in the sheet metal plate for the passage of the light bulb. A receiver opening is cut for a socket pin radially projecting out of the light bulb socket near an end of the flap.

A third end region of said flap is formed cylindrical for later providing a part of a cylinder jacket about concentric to the cylinder defined by a perpendicular projection of said opening. A second region of the flap adjoining the third region of the flap is bent in a direction which amounts in final positioning to a direction toward a cylinder defined by a perpendicular projection of said opening about an axis running about perpendicular to a plane of the opening. A first region of the flap adjoining a region of the opening and adjoining the second region of the flap is bent in a direction about parallel to a direction of insertion of a light bulb in the opening about a line running in parallel to the plane of the opening resulting in the axis of the cylinder jackets being about parallel to an axis running about perpendicular to the opening. The formed sheet metal piece can lockingly engage with a plastic support mount having springing arms with heads locking into a recess of the second region of the sheet metal plate.

The present invention provides that these guide flaps are cut out of one region of a sheet metal plate disposed outside of the opening for the passage of a light bulb socket. At least one of the guide flaps is bent around a first axis running tangential or coaxial to the opening and around a second axis for a second bending line running perpendicular to the first bending line and running in the same plane, where the bend in each case is about a right angle. The end section of the flap bent at two bending lines is formed as a part of a cylinder jacket, where the axis of the cylinder jacket runs about parallel to the second bending line.

Light bulbs employed in practical applications are provided at their base with such a large diameter that it is frequently sufficient to stamp one of the guide flaps from the area outside of the opening and to stamp the second guide flap out of the region which forms the opening for the bulb socket after the stamping.

According to a prefered embodiment of the invention the guide flaps are provided in the region between the bending lines with a locking engaging element for fixing the position of the socket in the receiver support mount. This locking engagement element can be provided as an opening, into which a head of a springing arm of the receiver support mount of the lamp support made from plastic protrudes and grips behind an edge of this opening. it is advantageous in this context, if the springing arm extends between the section of the flamp comprising the locking engagement element of the guide flap and the light bulb base. It is assured according to this embodiment that upon an insertion of the light bulb the engagement between the lamp socket and the receiver part cannot be released, since the springing arm is supported at the light bulb base. In order to give the mounting a solid and rattle free seat it is furthermore advantageous to cut out arms from the region of the sheet metal plate surrounding the opening for receiving the light bulb and to bend these arms out such that in a mounted state of the mounting, they rest under pretension at the support mount.

It is furthermore advantageous to maintain the bayonet slots receiving the light bulb in a closed state downwardly in the insertion direction. This is associated with the advantage that the guide flaps are stiffer in themselves and at the same time the insertion depth of the light bulb is limited when a light bulb is inserted. The bayonet slots are opened toward an edge neighboring to the insertion opening of the guide flap. A release recess is disposed oppositely to each slot opening. Such an embodiment has the advantage that light bulbs can only be inserted in a definite twist position. Furthermore this provides a possibility to form the passage opening for the light bulb base such that it corresponds in shape and diameter the base of the light bulb and thus provides a solid support edge for the light bulb base.

At least one of the release recesses in the opening edge extends over such a large arc of the circumference of the opening that the slot opening can be inserted in a different position into the guide flap. In this case the upper edge of the guide flap protruding into the release recesses provides an insertion blockage for such light bulbs that are not provided with the required position of the socket pins.

According to a further advantageous embodiment of the invention the open diameter between the two guide flaps is slightly smaller than the diameter of the light bulb base. Preferably the diameter is from about 1 to 2% smaller than the diameter of light bulb base. However in order to nevertheless be able to insert the light bulb easily the edge of the guide flap neighboring the opening is outwardly wedged as a guide bevel.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
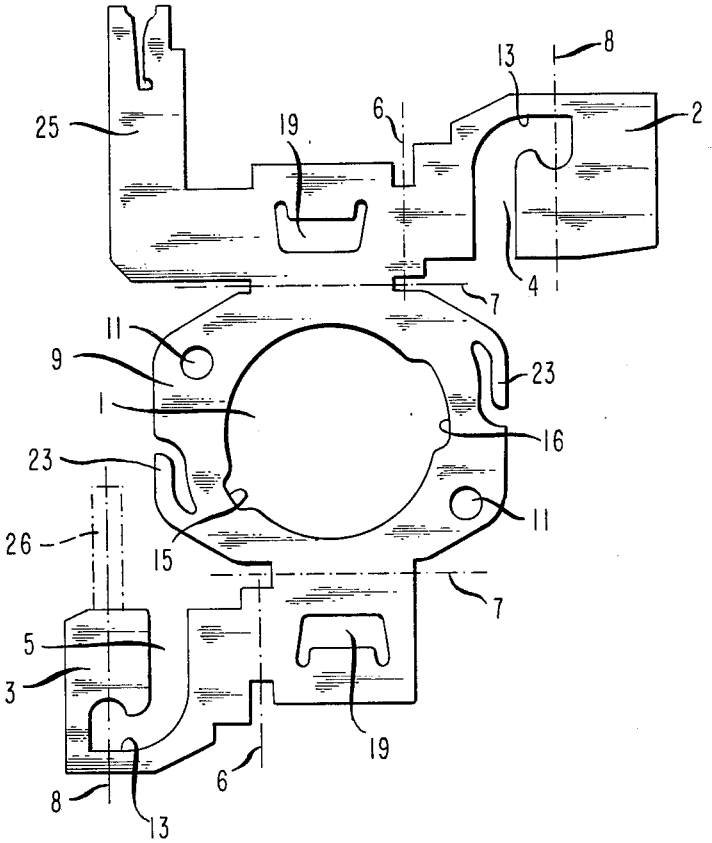
FIG. 1 is a plan view of a cut piece of sheet metal for forming a socket for holding a light bulb.
Figure 5:
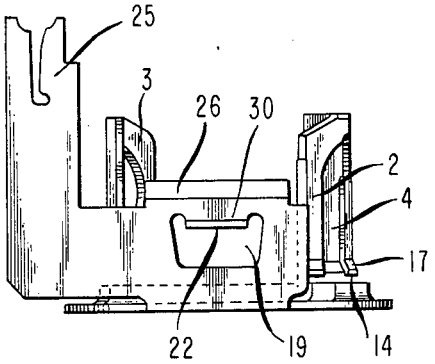
FIG. 5 is a plan view of a locking opening in a sheet metal flap.
Figure 4:
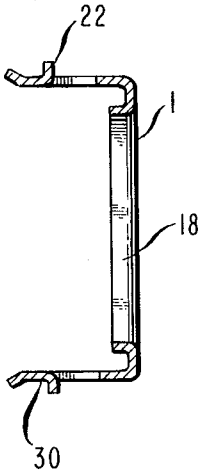
FIG. 4 is a sectional view along the section line IV—IV of FIG. 2.

In accordance with the present invention there is provided a mounting for an electrical light bulb with a bayonet lamp base, which is produced from a sheet metal plate. An opening is cut into the sheet metal plate for insertion of the light bulb base. Two support and guide flaps are cut out, bent and formed for the socket pins radially protruding from the light bulb base and for supporting the end section of the light bulb base protruding through the opening, which surround a part of the jacket of the light bulb socket. At least one of the guide flaps 2,3 is cut out of one region of the plate disposed outside of the opening 1 for the passage of the light bulb base 28. The guide flap is bent tangential or coaxial around the first bending line 7 running tangential or coaxial to the opening 1 and around a second bending line 6, running perpendicularly to the first bending line and running in the same plane as the first bending line. The bends around the bending lines are at an angle of about 90 degrees and are about at a right angle and the end section bend around the two bending lines 6, 7 is formed as part of a cylinder jacket, where the axis 8 of the cylinder jacket is parallel to the second ending line 6.

The guide flaps 2, 3 are provided in the region between the two bending lines with a locking element 19 for placing the sheet metal part of this socket in a fixed position.

A blank produced from a sheet metal plate or from a sheet metal strip by stamping is shown in FIG. 1 in a plan view. FIG. 1 illustrates the opening 1 for insertion of the light bulb the two guide flaps 2 and 3 with the receiver slots 4 and 5 for the socket pins 27 radially protruding from the light bulb base 28. The guide flaps 2 and 3 are bent in each case by about a right angle around the bending lines 6 and 7 after they have been formed running around the axis 8 like an arcuate circle.

The socket rests with its outer flange 9 on a plane support surface 24, of the receiver support mount 10, made from plastic. In order that the socket assumes the proper position to its receiver support part the openings 11 are inserted into the flange 9, into which the catch pins 12 of the receiver part 10 engage. The guide flaps 2 and 3 are bent backward around the bending line 7 at a right angle in the insertion direction of the light bulb base such that they run parallel to the light bulb axis. Furthermore the guide flaps 2 and 3 have received a further bending around the bending lines 6 such that the section of the guide flap forms a part of the jacket of a cylinder having circular cross section. The guide flap section is provided with the bayonet slots 4 and 5, which section had been bent previously as a circular shape around the axis 8, and which section contains the bayonet slots 4 and 5.

The bayonet slots 4 and 5 receiving the socket pins 27 of the light bulb base are closed rearwardly in the insertion direction of the light bulb. The light bulb cannot be slid too deeply into the socket and thereby over tension the contact, since prior to that the socket pins 27 of the light bulb would come to rest at bottom 13 of the bayonet slots 4 and 5. The bayonets slots 4 and 5 are open to the upper edge 14 of the guide flaps 2 and 3 such that the socket pins 27 of the light bulb can be inserted and slid into the bayonet slots.

In order for the opening 1 to fit with the light bulb base at a spacing as small as possible there are provided release recesses 15,16 at the edge of the opening 1, through which release recesses 15,16 the socket pins 27 of the light bulb can be slid upon insertion. These release recesses 15, 16 extend over such a large arc of the circumference of the opening 1 that for single and for multiple wire light bulbs, where the socket pins have different positions with respect to each other, no special release recesses and thus no particular tools are required. The different positions of the socket pins with different light bulb types are taken into consideration by giving the bayonet slots 4,5 in the guide flaps different positions. If it is attempted to insert a wrong light bulb into the socket then at least one of the two oppositely disposed socket pins of the light bulb is stopped at the upper edge 14 of the guide flaps 2,3.

The length of the flap at its end containing the slot for the bayonet pin can depend on the configuration necessary to fit with the extension of the second adjoining flap part. This can be recognized from FIG. 1 where the flap section 3 is smaller than the flap section 2 in view of the larger extension of the terminal part 25.

Preferably the upper section of the slots for receiving the bayonet pins is provided rounded with an upper opening from about two to four times the width of the guiding slot for the bayonet pin at the light bulb base. The shape of this guiding surface is preferably provided in the outer area of a steeper angle. The upper sections of this guide surface for the bayonet pins at the light bulb base can form an opening funnel angle of about 40 degrees For easy catching this angle can be increased further down the opening slot.

The open diameter between the two guide flaps 2, 3 is selected such that the guide flaps rest under pretensioning at the light bulb base. In order for the light bulb base not to be stopped upon insertion at the edge 14 of the guide flaps 2 and 3 and it thus be made difficult or impossible to insert the light bulb base there is provided in the upper region 17 a funnel shaped and outwardly bent bevel which is suitable for providing a guide bevel for the light bulb base to be inserted.

The edge 18 of the opening 1 is recesed in the insertion direction of the light bulb base. This recessed edge 18 makes it easier to insert the light bulb base. In particular the diameter of the opening is only slightly larger than the diameter of the light bulb base 28. The light bulb base thus receives in this region a solid and a non-yielding support.

The depth of the release recess can be from about 2 to 20% of the inner radius of the socket and is preferably from about 5 to 10% of the inner radius of the socket.

The angular extension of the release recess is preferably from about 10 to 50 degrees and more preferably between about 15 and 25 degrees.

The guide flaps 2,3 are provided with an opening 19 in the region between the two bending lines 6, 7 standing on top of each other at right angles to one another. The head 20 of the springing arms 21, which are formed at the receiver support mount 10, engages the lock opening 19 and the edge 22 grips behind that opening. The socket is thereby pressed with it's outer flange 9, against the support face 24, of the receiver part 10. In order to make this seating free from rattling the arms 23 are cut loose in the flange 9 of the socket. The arms 23, are bent through in the direction of their support surface 24 and thus generate a pretension. The springing arms of the receiver support mount grip from the side of the light bulb into the opening of the guide flaps such that they run between the guide flaps 2,3 and the light bulb base 28. It is thus achieved that the locking engagement between the springing arms 21 and the guide flaps 2,3 can not be released, since the arms 21 support themselves with their rear side against the light bulb base.

The lower edge 30 of the region receiving the engagement lock opening 19, of the guide flap 2,3 is bent to the outside and thus provides a guide bevel, at which the head 20 upon a sliding in of the lamp base slides along for locking and thus bends out the springing arm 21. The edge 22 of the opening 19 is bent outwardly, whereby a rounding is achieved at the inner side in order for the head 20 of the springing arm to spring back more easily into it's locking position.

The region of the guide flaps 2, 3 containing the locking opening 19 passes over into a tongue shaped extension terminal contact 25, which can be formed as a flat block or as an insulation displacement connector.

According to a preferred embodiment the lock opening 19 is provided of about rectangular shape having an elongated direction running in parallel to the first bending line. The opening 19 corresponds to 1/5 to ⅓ of the distance between the first bending line and the upper edge of the second region of the flap.

Figure 2:
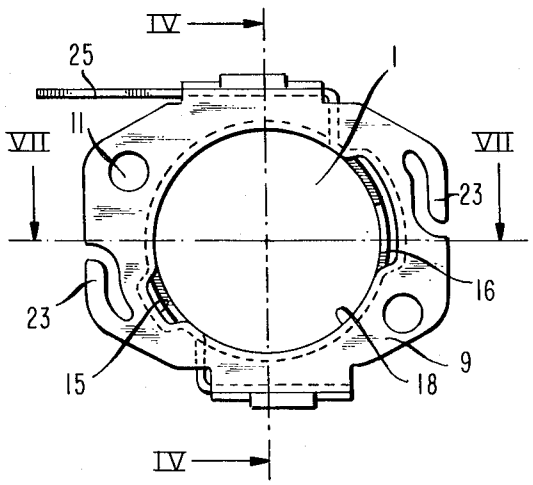
FIG. 2 is a front view of the socket in the direction of the light bulb access.
Figure 7:
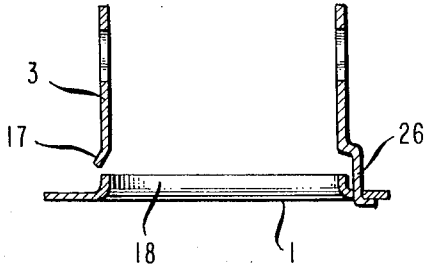
FIG. 7 is a view through the socket along section line VII—VII of FIG. 2.
Figure 3:
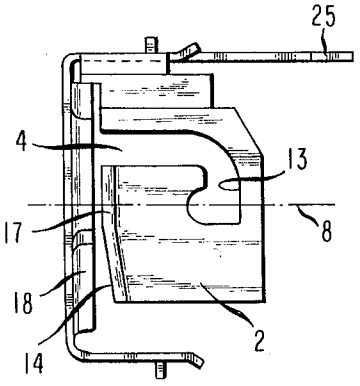
FIG. 3 is a side view from the right side.
Figure 6:
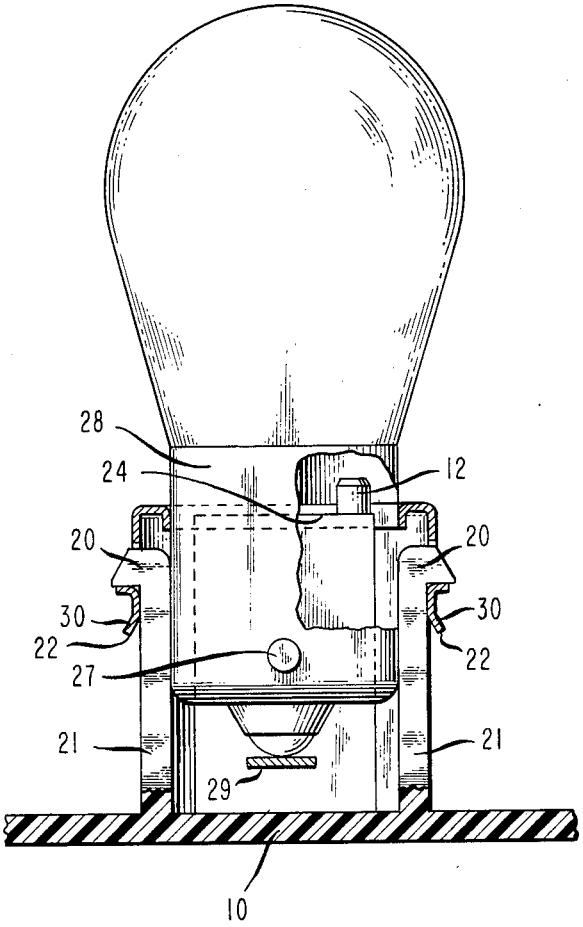
FIG. 6 is a sectional view in part broken up of the mounting for a light bulb in an assembled state.

A second embodiment of the guideflaps is illustrated in FIG. 7 on the right hand side. This guide flap designated as 3 is provided at its edge neighboring to the opening 21 with a tongue 26 (compare FIG. 2, dashed lines), which tongue protrudes through a recess in the flange 9 (FIG.7). The end of the tongue 26 penetrating and passing through is angled off as with a bevel. This embodiment fixes the position of the guide flap 2 such that it can not be bent backward upon insertion of a light bulb base 28.

The third end region of the flap with the locking slot for the bayonet pins is preferably disposed from about 1/50 to a 1/10 of its perpendicular extension from the plate section forming the passage through opening for the light bulb base with the exception of the engagement tongue 26.

It will be understood that each of the elements described above, or two or more together, may also find a useful application in other types of lamp support system configurations and lamp socket attachment procedures differing from the types described above.

While the invention has been illustrated and described as embodied in the context of an electrical light bulb with a bayonet socket, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A mounting for an electric light bulb which a bayonet lamp base formed of a sheet metal plate comprising an opening in the sheet metal plate providing a passage for the base of a light bulb;

two guide flap pieces where a first one of the guide flap pieces is cut from an area of the sheet metal disposed outside of the opening in the sheet metal plate for the passage of the light bulb and a second one of the guide flap pieces is cut from an area of the sheet mtal disposed outside of the opening in the sheet metal plate for the passage of the light bulb on the opposite side of the opening from the first one of the guide flap pieces, where a first region of each flap piece adjoining a region of the opening is bent in a direction parallel to a direction of insertion of a light bulb in said opening about a first bending line running in parallel to the plane of the opening and where a second region of each flap piece adjoining the first region of the flap piece is bent about a second bending line perpendicular to the plane of the opening in a direction toward a first cylinder defined by a perpendicular projection of said opening about an axis running about perpendicular to a plane of the opening and where a third region of the first flap piece adjoining the second region is formed as part of a second cylinder concentric to the cylinder defined by a perpendicular projection of said opening such that the axis of the cylinders is parallel to the axis running perpendicular to the opening and where each third region includes a receiver opening for a socket pin radially projecting out of the light bulb base.

2. The mounting for an electric light bulb with a bayonet lamp base made of a sheet metal plate according to claim 1 wherein a bending angle of about 90 degrees is formed around the first bending line and a bending angle around the second bending line sufficient to cause the second region of the guide flap pieces to follow the arcuate curvature of the first cylinder.

3. The mounting for an electric light bulb with a bayonet lamp base made of a sheet metal plate according to claim 1 further comprising a curved region joining the second and the third region of the flap piece forming part of a third cylinder where the radius of curvature is directed away from the axis of first and second cylinders.

4. The mounting for an electric light bulb with a bayonet lamp base made of a sheet metal plate according to claim 1 further comprising an extension of the first region of one of the flap pieces forming a contact tongue for electrically connecting the formed sheet metal plate to a pole of an electrical power source.

5. The mounting for an electric light bulb with a bayonet lamp base made of a sheet metal plate according to claim 1 further comprising a locking element disposed at the guide flap pieces for the light bulb base in the first region, where the locking element locks the formed sheet metal piece to a support mount.

6. The mounting for an electric light bulb with a bayonet lamp base made of a sheet metal plate according to claim 5 wherein the locking element is an opening for engaging a nose at a support mount for the formed sheet metal plate.

7. The mounting for an electric light bulb with a bayonet lamp base made of a sheet metal plate according to claim 6 further comprising a support mount including a springing arm supporting said nose.

8. The mounting for an electric light bulb with a bayonet lamp base made of a sheet metal plate according to claim 1 wherein the first region of the flap piece between the first bending line and the second bending line is formed as a protruding edge for locking the socket in a plastic support mount, where the protruding edge is gripped by a head of a spring-elastic arm of the plastic support mount.

9. The mounting for an electric light bulb with a bayonet lamp base made of a sheet metal plate according to claim 1 further comprising arms cut and bent out of an area of the sheet metal plate surrounding the opening for receiving a light bulb, which arms rest when mounted to a support mount at a receiver part of the support mount.

10. The mounting for an electric light bulb with a bayonet lamp base made of a sheet metal plate according to claim 1 wherein the receiver opening comprises a bayonet slot cut into the third region of the flap piece for receiving the socket pins of the light bulb is closed in a direction parallel to an insertion direction of a light bulb.

11. The mounting for an electric light bulb with a bayonet lamp base made of a sheet metal plate according to claim 1 wherein the receiver opening comprises a bayonet slot is open on the side of the edge of one of the guide flap pieces and directed toward the opening for the light bulb and wherein a release recess of the opening in the sheet metal plate is disposed opposite to the slot opening.

12. The mounting for an electric light bulb with a bayonet lamp base made of a sheet metal plate according to claim 11 wherein the release recess extends over such a large arc of a circumference of the opening in the sheet metal plate such that the opening of the slots allows a range of positions of a bayonet pin during insertion of a light bulb.

13. The mounting for an electric light bulb with a bayonet lamp base made of a sheet metal plate according to claim 1 wherein the open diameter between the cylinders of two flap pieces is slightly less than the nominal diameter of a light bulb base.

14. The mounting for an electric light bulb with a bayonet lamp base made of a sheet metal plate according to claim 13 wherein an edge of the guide flap pieces neighboring the opening for insertion of a light bulb is positioned outwardly as a guide bevel.

15. The mounting for an electric light bulb with a bayonet lamp base made of a sheet metal plate according to claim 1 further comprising a tongue formed at an edge of the guide flap piece neighboring a receiver opening, where the tongue is fixedly engaged with an edge of the receiver opening in the sheet metal plate.

16. The mounting for an electric light bulb with a bayonet lamp base made of a sheet metal plate according to claim 1 wherein the edge of the receiver opening is bent out of the direction of insertion of a light bulb.

17. The mounting for an electric light bulb with a bayonet lamp base made of a sheet metal plate according to claim 1 further comprising centering bores positioned in a planar edge of the opening of the sheet metal plate.

18. The mounting for an electric light bulb with a bayonet lamp base made of a sheet metal plate according to claim 1 wherein a line joining oppositely disposed socket pins of a light bulb forms an angle of more than about 80 degrees with a plane disposed perpendicular to the first bending line where the socket pins are in the locked rest position in the lamp base.

19. A method for producing a mounting for an electric light bulb with a bayonet lamp base formed of a sheet metal plate comprising cutting a sheet metal plate for defining an opening of said plate providing in the sheet metal plate a passage for the base of the light bulb, having one guide flap piece cut of an area of the sheet metal disposed outside of the opening in the sheet metal plate for the passage of the light bulb and cutting a receiver opening for a socket pin radially projecting out of the light bulb lamp base near an end of the flap piece, forming a third end region of said flap piece for later providing a part of a cylinder jacket about concentric to the cylinder defined by a vertical projection of said opening of said plate;

bending a second region of the flap piece adjoining the third region of the flap piece in a direction which amounts in final positioning to a direction toward a cylinder defined by a vertical projection of said opening about an axis running substantially perpendicular to a plane of the opening of said plate; and bending a first region of the flap piece adjoining a region of the opening of said plate and adjoining the second region of the flap piece in a direction about parallel to a direction of insertion of a light bulb in the opening about a line running in parallel to the plane of the opening of said plate resulting in the axis of the cylinder jacket being about parallel to an axis running substantially perpendicular to the opening of said plate.

20. The method for producing a mounting for an electric light bulb with a bayonet lamp base formed of a sheet metal plate according to claim 19 further comprising lockingly engaging the formed sheet metal plate with a plastic support mount having a springing arm with a head locking into a recess of the first region of the sheet metal plate.

* * * * *